US005870890A

United States Patent [19]

Baechler

[11] Patent Number: 5,870,890

[45] Date of Patent: Feb. 16, 1999

[54] METHOD AND APPARATUS FOR DETECTING THE MASS OF FIBER MATERIAL IN A SPINNING MACHINE

[75] Inventor: Francois Baechler, Wermatswil, Switzerland

[73] Assignee: Zellweger Luwa AG, Switzerland

[21] Appl. No.: 876,482

[22] Filed: Jun. 16, 1997

Related U.S. Application Data

[63] Continuation-in-part of Ser. No. 683,401, Jul. 18, 1996, abandoned.

[30] Foreign Application Priority Data

Jul. 19, 1995 [CH] Switzerland ..... 02 128/95

[51] Int. Cl.[6] ..... D01H 4/00

[52] U.S. Cl. ..... 57/412; 19/22; 19/24; 19/105; 57/264; 57/408

[58] Field of Search ..... 57/31, 264, 265, 57/408, 412; 19/22, 24, 105; 73/865

[56] References Cited

U.S. PATENT DOCUMENTS

| | | | |
|---|---|---|---|
| 2,670,503 | 3/1954 | Anderson | 19/23 |
| 2,679,073 | 5/1954 | Scott | 19/23 |
| 3,149,379 | 9/1964 | West et al. . | |
| 4,050,228 | 9/1977 | Landwehrkamp et al. | 57/417 |
| 4,742,675 | 5/1988 | Leifeld | 19/105 |
| 4,785,505 | 11/1988 | Leifeld | 19/105 |
| 4,860,406 | 8/1989 | Stäheli et al. | 19/105 |
| 4,926,627 | 5/1990 | Barun et al. | 57/412 |
| 4,955,266 | 9/1990 | Stäheli et al. | 57/412 |

FOREIGN PATENT DOCUMENTS

| | | |
|---|---|---|
| 2905589 | 8/1980 | Germany . |
| WO 93/09280 | 5/1993 | WIPO . |

*Primary Examiner*—William Stryjewski
*Attorney, Agent, or Firm*—Burns, Doane, Swecker & Mathis

[57] ABSTRACT

The invention relates to a method and device for detecting the mass of fiber material (5) which is processed in a rotor spinning machine to form yarn. In order to obtain a measurement signal which is a function of the mass of fiber material and which can also be used for controlling or monitoring a spinning station without requiring an independent measuring device, this measurement signal is detected in the spinning station of a rotor spinning machine on the feed trough (1) thereof.

9 Claims, 4 Drawing Sheets

METHOD AND APPARATUS FOR DETECTING THE MASS OF FIBER MATERIAL IN A SPINNING MACHINE

The present application is a Continuation-in-Part Application of U.S. application Ser. No. 08/683,401, filed Jul. 18, 1996 and abandoned as of Jun. 18, 1997, the disclosure of which is hereby incorporated by reference in its entirety.

FIELD OF THE INVENTION

The invention relates to a method and device for detecting the mass of fiber material in a sliver or other elongated body being processed. The invention is concerned particularly with fiber mass detection in rotor spinning machines, but it may be applied in other types of machines as well.

BACKGROUND OF THE INVENTION

Known rotor spinning machines include many spinning stations. Each is sometimes referred to as a "spinning box." A sliver or a fiber strip is applied to each such station. A so-called feed trough is located at the entrance to each spinning station to receive the fiber strip and press it against a rotating feed roller, so that the fiber material will be drawn over the feed trough by the feed roller. The feed trough can be constructed as a type of lever or flap which is pivotally mounted and extends in the vicinity of the feed roller approximately tangentially thereto. After the feed roller, the fiber material is taken up by a separating roller where the fibers are separated.

The weight of fibers advanced per unit of time by the feed roller is an important factor with respect to the size of the yarn produced at the spinning station of a rotor spinning machine. Also, the uniformity of the mass of fibers along the length of the strip forming the input to the spinning station is an important factor with respect to the uniformity of the resulting yarn. However, if the thickness or mass of the fiber material is to be measured in the vicinity or region of a spinning station, then it is necessary to arrange measuring devices, such as measuring hoppers etc., upstream or downstream of the spinning station. But, this can only be done where space for a measuring device is available along the route of the supplied fiber material. If this space is available, a measuring device can be provided. However, this generates resistance in the fiber material which needs to be overcome and which can influence the fiber material in an unexpected manner.

SUMMARY OF THE INVENTION

An object of the invention is to provide a method and a device to obviate the above-mentioned disadvantages and allow the mass of fiber material drawn into a spinning station rotor to be measured.

This object is attained by detecting the mass of the fiber material in the region of a feed roller of a spinning station of a rotor spinning machine. A device suited to this end comprises a measuring element on the feed trough, which measuring element is constructed to transmit a signal corresponding to the mass of fiber material on the feed trough. This measuring element preferably is integrated into the feed trough structure.

Measuring elements of this type can trace the surface of the fiber material, can follow the thickness irregularities, and can effect deflections which can be converted into information relating to a path or a pressure. Accordingly, the measuring elements comprise tracer elements which are connected to a pressure measuring element or path measuring element. More particularly, resistance strain gauges, optically or capacitively operating path recorders, or pneumatically or piezoelectrically operating pressure recorders can be provided as measuring elements.

Multiple advantages are obtained in this manner. On the one hand, the fiber material is required to pass through fewer elements, each of which may have an unfavorable effect on the material. On the other hand, the spinning machine requires one element less, so that the spinning station and its environment remains more accessible. A further advantage is that the generated measurement signals are particularly suitable for controlling the spinning station in such a manner that the spinning station can be directly regulated. Mass fluctuations in the fiber material can be obviated in the spinning station itself by way of a suitable control intervention. The possibility of examining the quality of the fiber material prior to processing into yarn is also made available in this manner.

BRIEF DESCRIPTION OF THE DRAWINGS

The invention is explained in further detail in the following with the aid of examples and with reference to the attached drawings, in which.

DETAILED DESCRIPTION OF PREFERRED EMBODIMENTS

Figure 1:
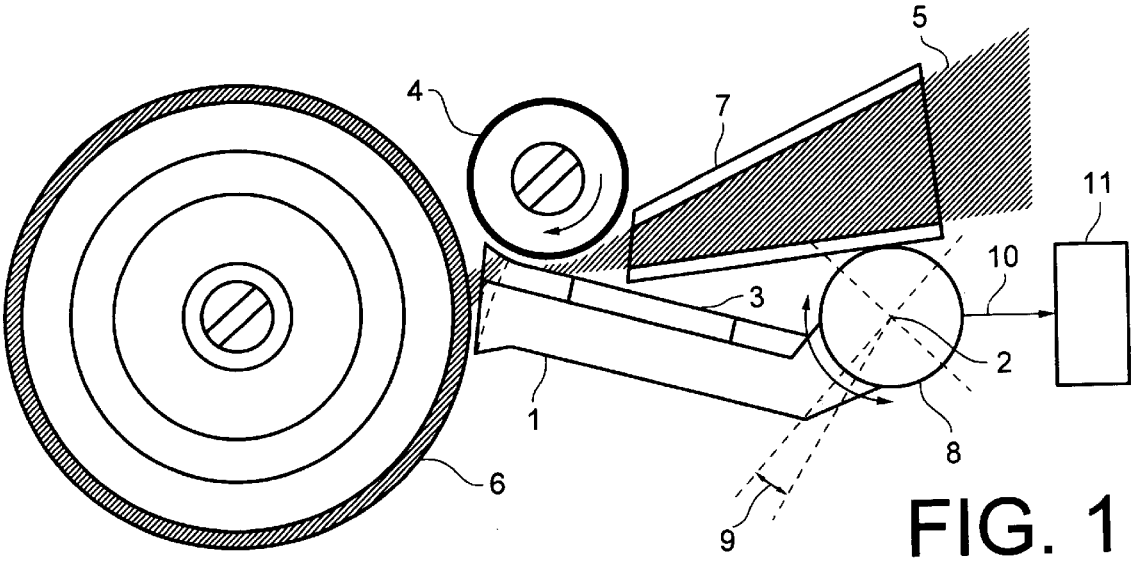
FIG. 1 is a schematic showing of a side view of a fiber feeding and measuring system for delivering fibers to a rotor spinning station.

FIG. 1 shows a device with a feed trough 1. In this case, the feed trough is mounted so as to rotate about an axis 2 within a restricted range and comprises a guide surface 3 for fiber material 5. The surface 3 is arranged approximately tangential to the circumference of a feed roller 4 so long as the feed trough is in its operative position. Located downstream of the feed roller 4 is a separating roller 6. In addition, guides 7 for the fiber material are provided upstream, for guiding the fiber material onto the feed trough 1. Also arranged on the feed trough 1 is an angle transmitter 8 which serves as a measuring element. This determines an angle which is proportional to the thickness or mass of the fiber material 5 between the guide surface 3 and the feed roller 4. The angle transmitter 8 is connected via a line 10 to an evaluating unit 11. This has the tasks of supplying the measuring element with energy, of detecting and amplifying signals from the measuring element and of offering the possibility of calibration, zero point adjustment, normalization of the signals and/or compensation of interferences. In the same context, a displaceable feed trough may be provided in place of the illustrated pivotable feed trough. A path would then need to be recorded rather than an angle.

Figure 2:
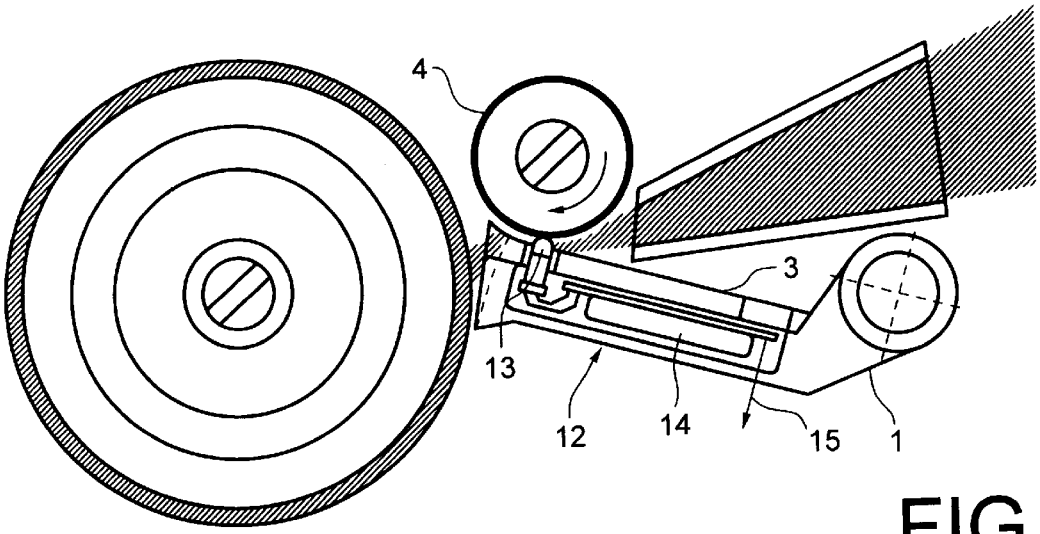
FIG. 2 is a schematic view similar to FIG. 1 showing an embodiment constructed in accordance with the present invention.

FIG. 2 shows a further embodiment in which a measuring element 12 is fitted beneath the guide surface 3 in the supply trough 1. The measuring element 12 comprises a tracer element 13 and an evaluation circuit 14. In this case, the tracer element 13 is constructed as a resilient measuring bar having a fiber contacting portion which can flex toward and away from the adjacent surface of the feed roll 4 in response to the pressure variations generated as a fiber strip of fluctuating mass or thickness is drawn between the roll 4 and element 13. Resistance strain gauges are fitted on the element 13 in a bridge circuit. The evaluation circuit is connected to the bridge circuit and comprises, for example, an amplifier. Here too, the output signal can be transmitted via a line 15 to an evaluation unit.

Figure 3:
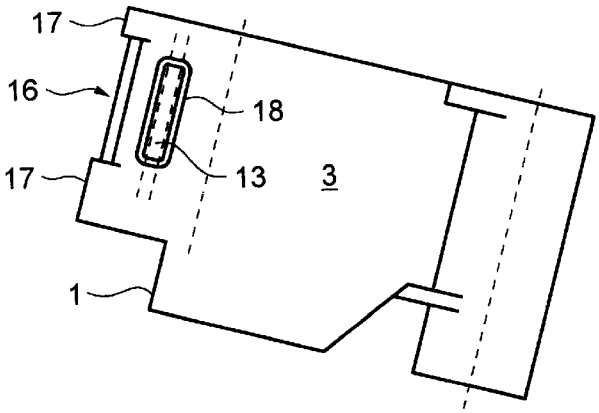
FIG. 3 is a plan view of the fiber supply trough of an embodiment constructed in accordance with the invention.

FIG. 3 is a plan view of the supply trough 1 in which an outlet duct 16 for the fiber material is particularly visible. The outlet duct 16 is defined laterally by projecting limits 17. The guide surface 3 of the feed trough 1 comprises a window 18, through which the tracer element 13 can project.

Figure 4:
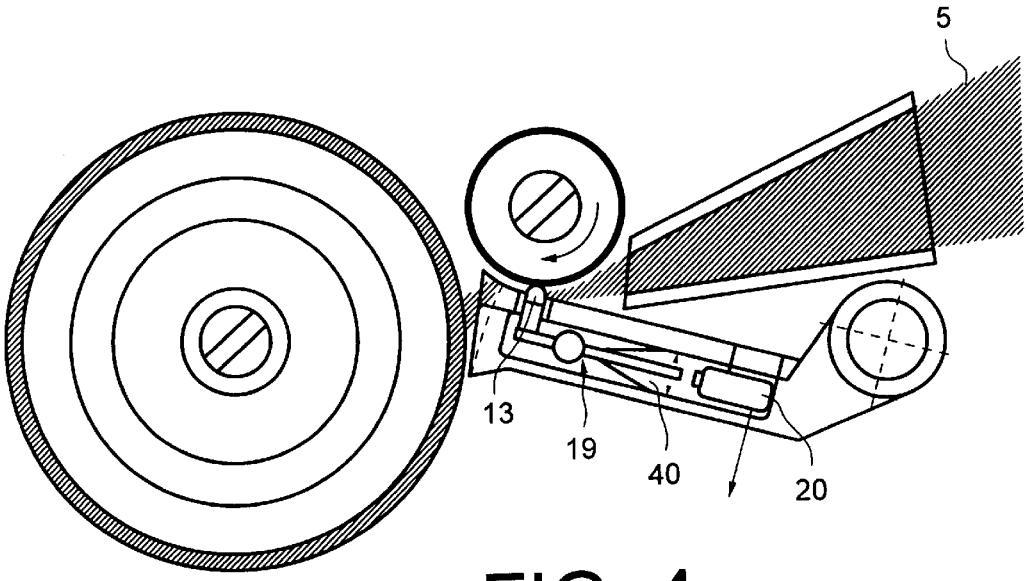
FIG. 4 is a view similar to FIG. 2 but showing another embodiment.

FIG. 4 shows an embodiment in which the tracer element 13 is connected to a lever system 19. This in turn cooperates with a path recorder 20. In this case, the tracer element 20 is loaded by a spring, not shown, which presses the tracer element against the fiber material 5.

Figure 5:
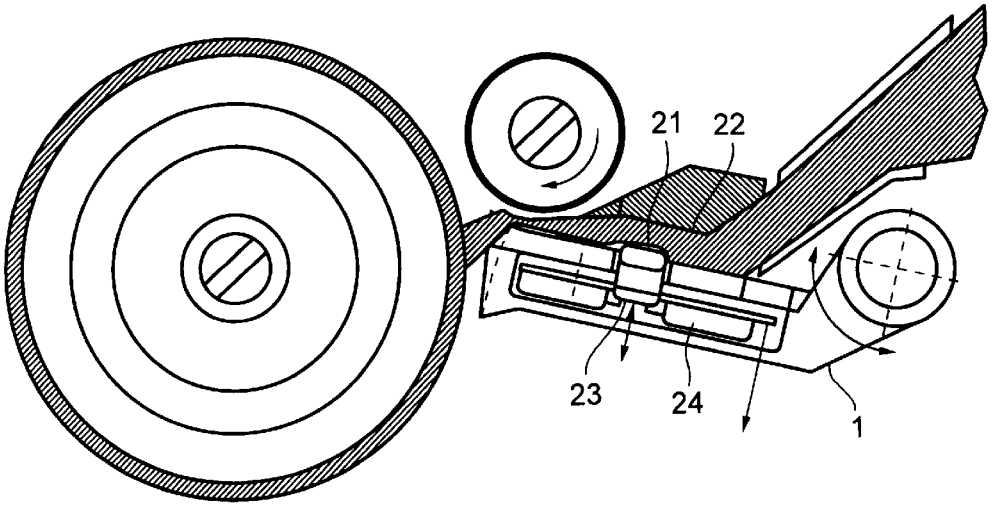
FIG. 5 is a view similar to FIG. 4 but showing an embodiment of the invention in which a guide presses the incoming fiber strip against the feed trough and an adjacent tracer element.

FIG. 5 shows an embodiment with a projecting tracer element 21, which is arranged opposite an additional guide 22 also arranged on the feed trough 1. The tracer element 21 acts upon a spring 23, which is provided with resistance strain gauges. These are again arranged in a bridge circuit. An evaluation circuit 24 with an amplifier is also provided.

Figure 6:
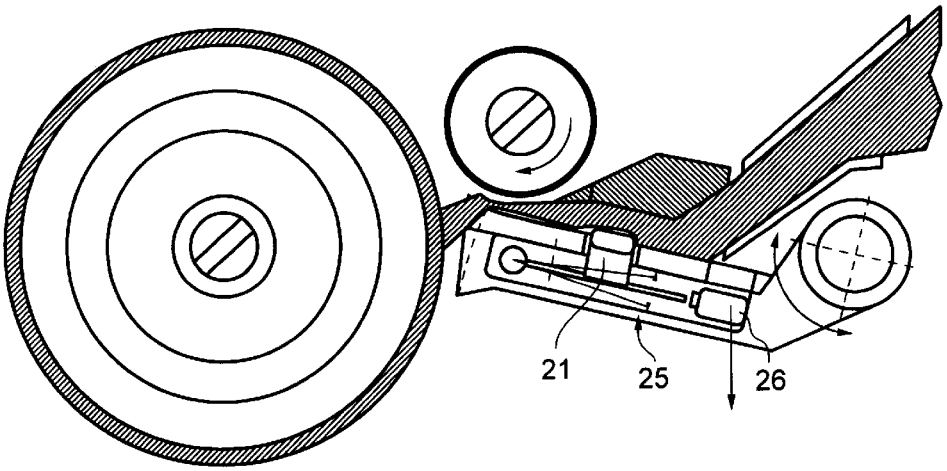
FIG. 6 is a view similar to FIG. 5 showing another form of means for deriving an electrical signal from the sensing of the fiber mass.

FIG. 6 shows an arrangement of a tracer element 21 comparable to that of FIG. 5, although in this case the tracer element 21 cooperates with a lever system 25 which can amplify or reduce the deflections of the tracer element 21 depending on its design. Here too, a path recorder 26 is provided for detecting the deflections of the lever system 25.

Figure 7:
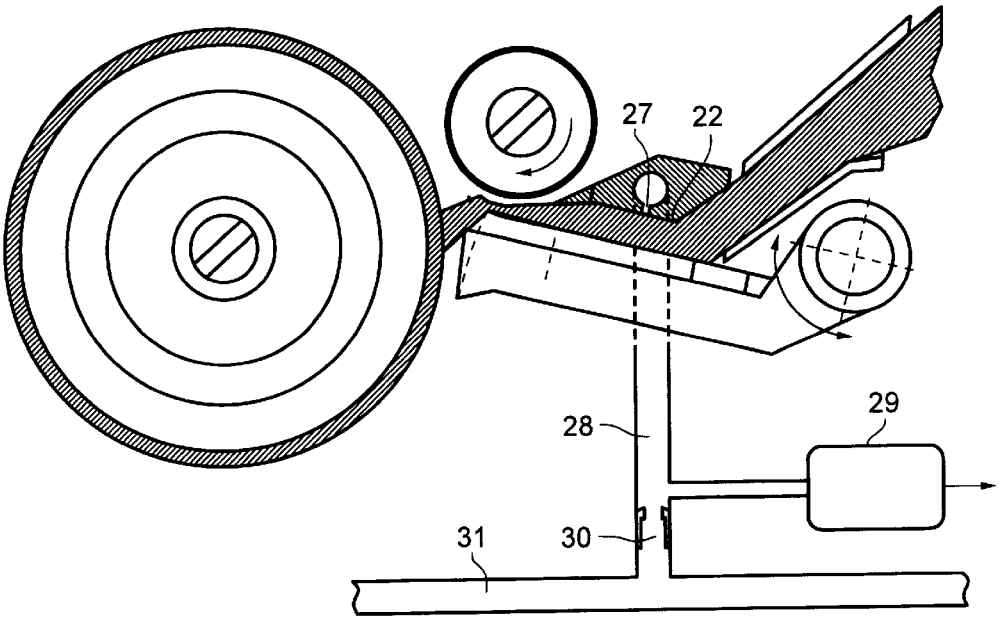
FIG. 7 is a view of another embodiment similar to FIG. 5 but having a different sensing system.

FIG. 7 shows a system which operates according to a passive pneumatic measuring principle. Here, the guide 22 comprises an aperture 27 leading to the fiber material. The aperture 27 acts as a measuring element and is connected via a line 28 to a pressure converter 29. The line 28 is also connected via a pilot nozzle 30 to a supply line 31. The pressure converter 29 can thus be connected to a pilot chamber as disclosed in Swiss Patent Application CH 1828/95 and its counterpart U.S. Application filed Jun. 21, 1996 in the names of inventors Francçois Baechler and Jürg Zehr, the disclosures of which are incorporated herein by reference. In this case, the supply line 31 preferably serves a plurality of spinning stations, with the pressure being the same for all the feed troughs connected thereto.

Figure 8:
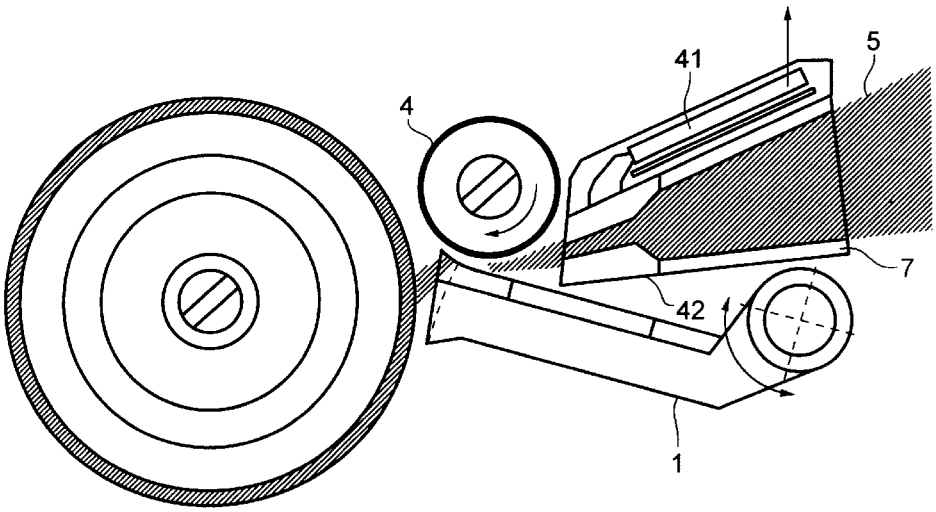
FIG. 8 is a view generally similar to FIG. 1 but showing an embodiment in which a capacitive sensing system gauges the mass of the fiber strip being drawn into the spinning station.

FIG. 8 shows a system with a capacitively operating measuring element 42 arranged on the guide 7 directly upstream of the feed roller 4. The capacitance of the measuring element is built into a bridge circuit, which is in turn connected to an evaluation unit 41.

The method of operation of the different systems is as follows: In the embodiment according to FIG. 1, the position of the feed trough 1, which is expressed by the angle 9, provides a measurement for the thickness or mass of the fiber material 5. In this case, it is necessary for the feed trough 1 to be spring-loaded and mounted so as to be easily displaceable. A signal, which expresses the angle 9, is transmitted via the line 10 to the evaluation unit 11, which displays the signal or prepares it in such a manner that it can be used for a form of control or monitoring which takes the angle 9 into account.

In the embodiment according to FIG. 2, an optimum operating point for the measurement system is sought by adjusting the distance between the feed trough 1 and the feed roller 4 and the feed trough 1 is then fixed in this position. The fiber material therefore only moves the tracer element 13, which bends a measuring bar to a greater or lesser degree. The bending is detected in a manner known per se by resistance strain gauges.

Also in the embodiment according to FIG. 4, only the tracer element 13 moves and this in turn moves a lever 40, whose deflection is detected.

The tracer elements 13, 21 as shown in FIGS. 2 to 6 are much smaller in dimension and have a weight which is much smaller than that of the feed trough 1. Therefore such tracer elements 13, 21 have a much reduced inertia and can much better follow variations of the thickness of the fiber material. Such tracer elements may also detect variations of shorter wavelength in the fiber mass.

Comparable processes occur in the embodiments according to FIGS. 5 and 6, with the difference that in these cases it is no longer necessary to adjust the position of the feed trough 1 relative to the feed roller 4. In this case, it is necessary to adjust the position of the guide 22 and its distance from the guide surface of the trough 1 in order to obtain the optimum operating point.

In the embodiment according to FIG. 7, it is also necessary to adjust the position of the guide 22. However, in this case the pressure in the line 31 and the size of the nozzle 30 also plays a part in obtaining an optimum method of operation.

In the embodiment according to FIG. 8, the feed trough 1 can be arranged so that it is fixed in position. The mass of the fiber material 5 supplied as a fiber strip is measured as close as possible to the feed roller 4.

The embodiments shown in FIGS. 5 to 8 additionally (to the lower inertia of the tracer or measuring elements) are advantageous in that the fiber material is not compressed as much as in the clearance between the feed trough 1 and the feed roller 4, or the rate of compression may be chosen or influenced by corresponding dimensions. This is due to the fact that the measuring elements are located upstream of the feed roller or the clearance or gap between the feed roller and the feed trough. Therefore, the friction between the fiber mass and the sensor is smaller and the sensor may react better to variations of the fiber mass. In such case, variations in the fiber mass are known at a time when the variations can be corrected more easily by an action on the feed roller.

Figure 9:
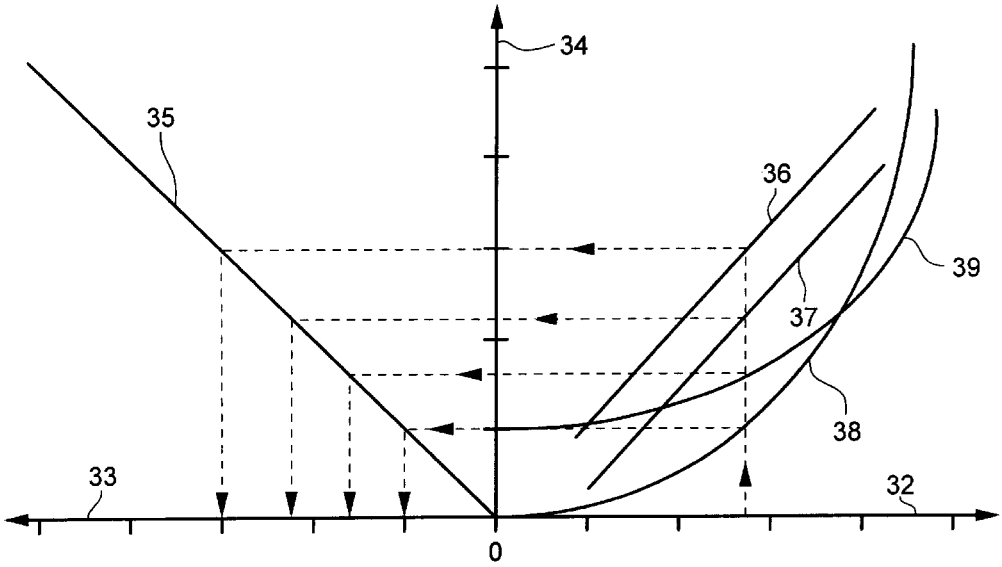
FIG. 9 is a graph illustrating the paths of the measurement values and derived signals.

The systems illustrated in FIGS. 1 to 8 have different characteristics, as is shown in FIG. 9. In FIG. 9, values for the mass of the fiber material are indicated on the axis 32 and values of an electrical signal (for example in volts or amperes, of a frequency or of a digital signal) are indicated on the axis 33, and values corresponding to a physical measurement (e.g. values corresponding to an angle, a pressure, a force or a path) are indicated on the axis 34. As the straight line 35 indicates, it can be assumed that a linear correlation exists between the last mentioned values and the values of electrical signals. In contrast, it depends upon the measurement principle whether a linear correlation exists between the values corresponding to a deflection and the values corresponding to a mass. The lines 36 and 37 illustrate the correlation in a system according to FIG. 1 and systems according to FIGS. 4, 6 and 8. A curve 38 illustrates the correlation in the systems according to FIGS. 2 and 5, whilst the line 39 illustrates the correlation in pneumatically operating systems according to FIG. 7. From these characteristic curves 36, 37, 38 and 39, it is possible to select a working range within which the fluctuations in mass should approximately fall by correspondingly adjusting the feed trough 1 relative to the feed roller 4 or adjusting the guide 22 relative to the guide surface of the trough 1.

Conditions similar to those in rotor spinning machines are present also in other types of spinning machines operating according to the known principles of air-spinning, wrap-spinning and friction-spinning, and the measuring elements described above may also be used in relation to such spinning machines or processes.

What is claimed is:

1. A method for detecting the mass of a sliver or band of fiber material in a machine having a feed trough over which said sliver or band of fiber material passes and a driven feed roller adjacent said feed trough for compressing said sliver or band of fiber material against said feed trough and feeding the fiber material lengthwise off an end portion of said feed trough, said method comprising measuring the mass of the fiber material as it passes over said feed trough in a region upstream from said feed roller and before said feed roller compresses said sliver or band of fiber material against said feed trough.

2. A method according to claim 1, wherein the mass is detected on a guide surface of said feed trough.

3. A method according to claim 2, wherein the fiber material is sensed by a tracer element moveable relative to said feed trough.

4. A method according to claim 1, wherein said fiber material is sensed capacitively.

5. A method according to claim 1, wherein a pressure converter is employed in detecting the mass of the fiber material.

6. Apparatus for detecting the mass of a sliver or band of fiber material in a spinning machine, comprising an elongated feed trough for receiving fiber material to be processed, a driven feed roller adjacent an end portion of said feed trough for feeding the fiber material therebetween, and measuring means constructed and arranged for the transmission of a signal corresponding to the mass of the fiber material passing along said feed trough, said measuring means including a small tracer element moveable relative to said feed trough at a location upstream of said feed roller for contacting the fiber material before it passes into the region between said feed roller and said feed trough.

7. Apparatus according to claim 6, wherein said tracer element is connected to an evaluation circuit and is moveable through an opening in a guide surface of the feed trough.

8. Apparatus according to claim 7, wherein the evaluation circuit is arranged in the feed trough.

9. Apparatus according to claim 6, including a guide spaced from said feed trough at the location of said tracer element to guide the fiber material into contact with said tracer element.

* * * * *